United States Patent [19]

Kröger et al.

[11] 4,218,174

[45] Aug. 19, 1980

[54] LOAD-TRANSPORTING METHOD AND APPARATUS

[75] Inventors: Keijo K. Kröger, Tampere; Pekka E. Ojanen, Pirkkala, both of Finland

[73] Assignee: Valmet Oy, Finland

[21] Appl. No.: 878,755

[22] Filed: Feb. 17, 1978

[30] Foreign Application Priority Data

Feb. 18, 1977 [FI] Finland ..... 770539

[51] Int. Cl.[2] ..... B66F 9/00

[52] U.S. Cl. ..... 414/786; 414/338; 414/442

[58] Field of Search ..... 414/434–436, 414/338, 334, 442, 390, 392, 394, 396, 460, 461, 786

[56] References Cited

U.S. PATENT DOCUMENTS

| | | | |
|---|---|---|---|
| 2,649,217 | 8/1953 | Mertes | 214/350 |
| 3,224,613 | 12/1965 | Bowman-Shaw | 214/396 |
| 3,515,299 | 6/1970 | Esser | 214/350 |
| 3,743,125 | 7/1973 | Ashley, Jr. | 214/515 |
| 3,759,409 | 9/1973 | Wenzel | 214/394 |

*Primary Examiner*—Stephen G. Kunin
*Assistant Examiner*—Terrance L. Siemens
*Attorney, Agent, or Firm*—Steinberg & Blake

[57] ABSTRACT

A load-transporting method and apparatus involve use of a transport vehicle, preferably a straddle truck, having connected thereto a load carrier in the form of a frame which is capable of engaging a load and elevating the same with respect to a given surface on which the load initially rests when the load-carrier is raised with respect to this surface. The connection between the load carrier and the vehicle is such that once the load is engaged by the load carrier, the travel of the vehicle with respect to the load causes the load carrier to act through its connection to the vehicle on the latter in a manner which resists the travel of the vehicle and causes the load to move frictionally with respect to the above surface on which it initially rests, the kinetic energy of the travelling vehicle and the friction of the load with respect to the surface and/or the inertia of the load being utilized to bring about elevation of the load and the load-carrier with respect to the above surface.

10 Claims, 7 Drawing Figures

FIG. 3
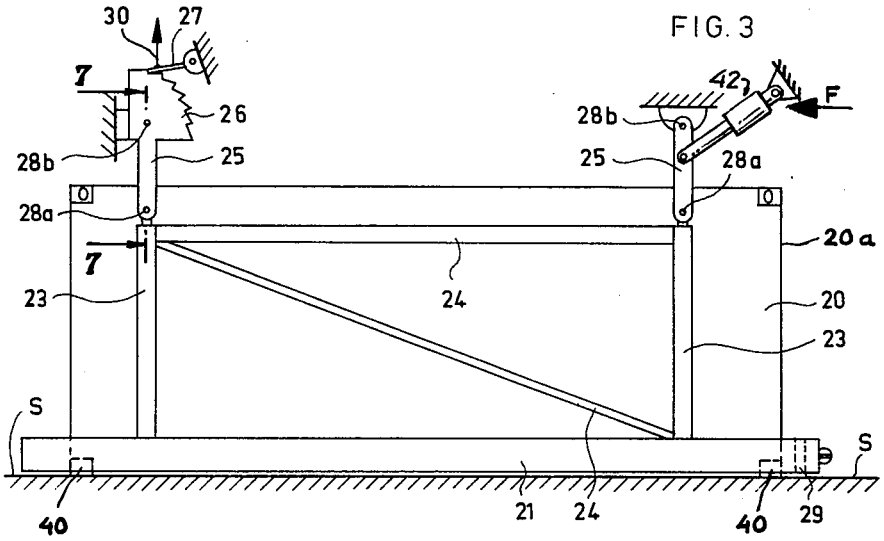
FIG. 4
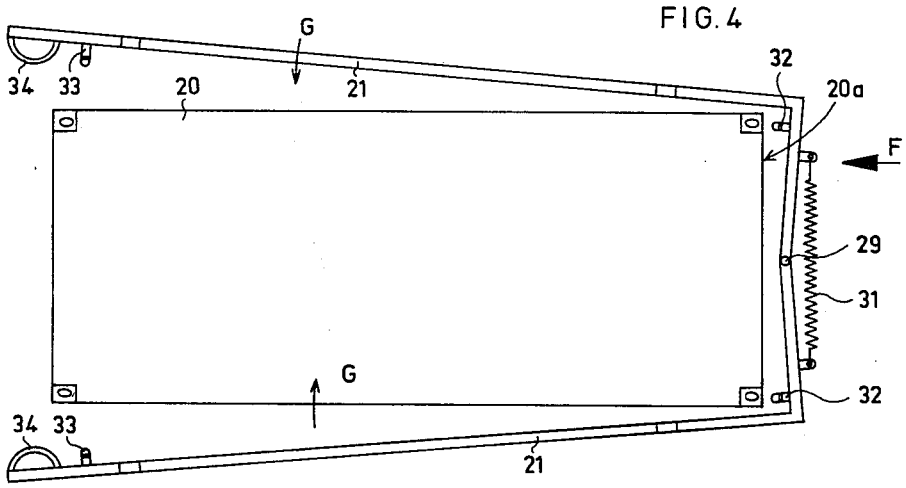
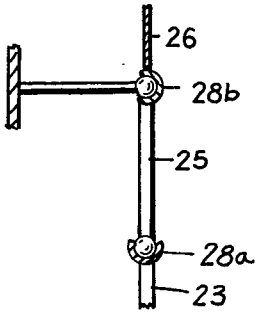
FIG. 7

LOAD-TRANSPORTING METHOD AND APPARATUS

BACKGROUND OF THE INVENTION

The present invention relates to methods and apparatus for transporting loads.

In particular, the present invention relates to a method and apparatus according to which a vehicle such as a straddle truck is utilized to bring a load, such as a container and material situated therein, into a substantially horizontal transport position, the invention involving initially engagement of the load which is to be transported with a special load-carrier means capable of gripping and raising the load while engaging the latter preferably at lower corner regions thereof.

As is well known, in locations such as harbors and terminals loads in the form of containers with various materials therein are required to be transported through relatively short distances ranging from a few meters to a distance of approximately two kilometers. In addition, at the locations where such loads are handled it is usually required that the loads be displaced without requiring stacking of the loads one upon the other.

In locations such as harbors and terminals, loads such as containers with various materials therein are conventionally transported by utilizing structures such as fork-lift trucks which are provided with special lifting means so that the loads can be horizontally transported. Such fork-lift trucks are utilized primarily for short transport distances. The drawbacks of fork-lift trucks reside in the fact that they have a comparatively small useful load-carrying capacity, resulting from the fact that the location of the load makes it essential to utilize on fork-lift trucks massive counterweights. Moreover, fork-lift trucks require wide avenues to be maintained clear for travel of such vehicles and the loads carried thereby.

It is also known to utilize in the transportation of loads of the above type conventional straddle trucks provided at their upper regions with top-lift means. Such means are bulky, requiring a large amount of space particularly in a vertical direction. A further drawback of straddle trucks is that a considerable time and inconvenience are involved in aligning such a straddle truck with respect to a load which is to be transported, so that these operations go forward only slowly.

In addition, increasing use has been made in recent times of tow trucks and trailers in order to transport loads such as containerized loads, these trailers being so-called float carriages in the form of low trailers provided with relatively small wheels having a diameter on the order of 200 mm, of which a considerable number, for example 8 to 16, are required in bogies.

The drawback of this latter type of arrangement resides in the fact that in addition to the tow truck there will normally be approximately three trailers for each tow truck in order to be able to carry out normal operations.

SUMMARY OF THE INVENTION

It is a primary object of the present invention to provide a method and apparatus according to which the above drawbacks can be avoided.

A special object of the present invention resides in providing a method and apparatus according to which it is possible to handle loads of the above type at locations such as harbors and terminals with costs in connection with the apparatus and energy utilized which are lower than has heretofore been possible.

It is also an object of the present invention to provide a method and apparatus according to which advantage is taken of the fact that such harbors and terminals normally are completely paved, so that the transporting equipment operates on relatively smooth, level surfaces.

Yet another object of the present invention is to provide a method and apparatus according to which the loads are raised from and lowered onto the surface which is directly engaged by the load itself, so that there is a considerable advantage as compared with structures such as the above truck- and trailer combinations which require the loads to be supported on the surfaces of the trailers, for example.

According to the invention after the container has been engaged by a load-carrier means which is capable of moving with respect to the transport vehicle such as a straddle truck substantially in the direction of travel thereof, the kinetic energy of this transport vehicle and the friction and/or inertia forces of the load itself are utilized to turn or shift the load from the position in which it is initially engaged by the load-carrier means in such a way that the load will be raised at least partially as a result of the above forces into a substantially horizontal transporting position.

The structure of the invention includes a number of lifting arms pivotally connected at their upper ends to the frame of the straddle truck and at their lower ends to a frame which performs part of the load-carrier means and which serves to engage and grip the load which is to be transported. In connection with the above lifting arms the structure of the invention includes a releasable locking means which locks the lifting arms in a position which the load is capable of being horizontally transported, this position being one where the lifting arms are turned with respect to their unloaded positions.

Thus, as is evident from the above, with the present invention the kinetic energy of the straddle truck and/or the inertia forces of the load are utilized so that energy costs will be low in connection with lifting of the load. On the other hand, with the invention it is possible to utilize structures which are relatively simple and highly reliable in operation.

Furthermore, by utilizing a load-carrier means which engages the load at the lower corner regions thereof, the variation in height of different loads will not produce any problem. At the present time conventional loads include containers which have different heights such as heights of 8', 8½', 9' and 9½', and these different heights of the containers of conventional loads create problems with conventional apparatus and methods.

As contrasted with known straddle trucks, the top-lift means conventionally utilized may be totally omitted with the present invention inasmuch as the lower region of the load is always at a constant height, thus resulting in considerable saving in apparatus costs, taking into consideration the costs involved in hydraulic lifting apparatus, for example.

BRIEF DESCRIPTION OF DRAWINGS

The invention is illustrated by way of example in the accompanying drawings which form part of this application and in which:

FIG. 3 is a schematic side elevation illustrating a load-carrier means of the invention during the time when it is operated to engage a load;

FIG. 4 is a schematic top plan view of the structure of FIG. 3;

FIG. 7 is a schematic illustration of part of the structure of FIG. 3 taken along line 7—7 of FIG. 3 in the direction of the arrows.

DESCRIPTION OF PREFERRED EMBODIMENTS

Figure 1:
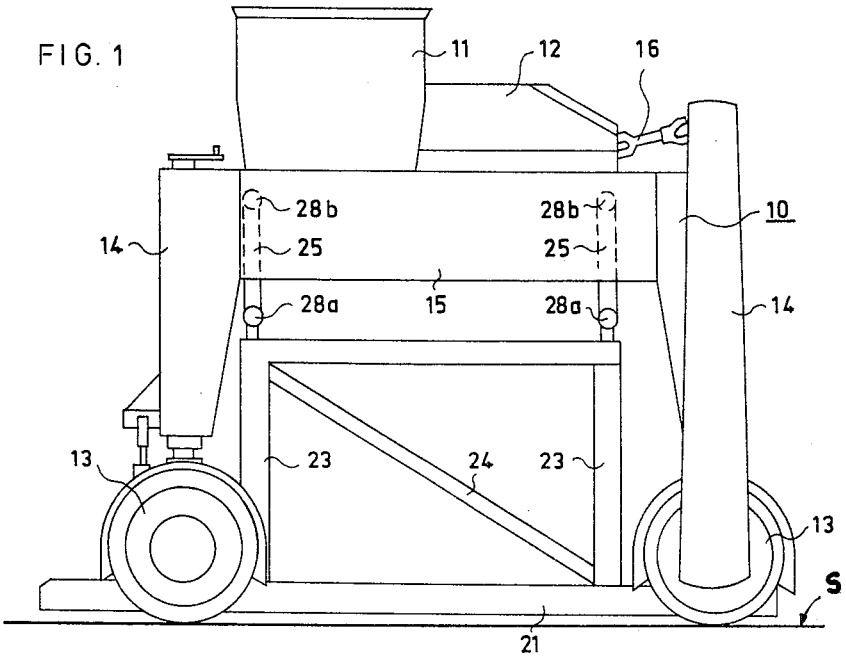
FIG. 1 is a schematic side view of a straddle truck provided with the apparatus of the invention, the apparatus of FIG. 1 being capable of carrying out also the method of the present invention.
Figure 2:
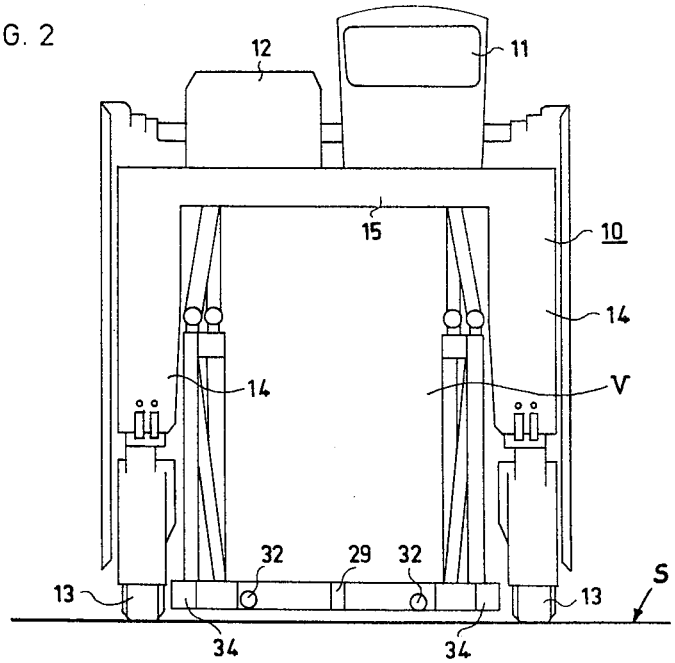
FIG. 2 is a schematic end elevation of the structure of FIG. 1 as seen from the left of FIG. 1.

Referring to the drawings, the straddle truck 10 illustrated schematically in FIGS. 1 and 2 forms the transport vehicle utilized in the illustrated apparatus and method of the invention, and this straddle truck 10 is in itself conventional and well known. Thus, the straddle truck includes a cab 11 for the operator, an engine 12, vertical frame structure 14 and horizontal frame structure 15 extending therebetween so as to define in this way by way of the straddle truck frame structure 14, 15 the space V for receiving the load which is to be transported, this load in the illustrated example including the container 20 in which there is the material which together with the container 20 is to be transported. The transport vehicle 10 includes wheels 13 which themselves include air-inflated tires, and the drive from the engine 12 to the wheels 13 is conventional and includes the schematically illustrated drive shaft 16 (FIG. 1) which has at its opposed ends universal joints as is well known.

The load-engaging means of the invention includes a plurality of arms or levers 25. Four such arms 25 are provided in the illustrated example. These arms 25 form lifting arms and are connected at their upper ends to the frame of the vehicle 10 by way of pivots **28*b*, respectively, so that the illustrated four arms 25 are pivotally connected by the pivots 28*b* at the upper ends of the arms 25 to the vehicle 10. The four lifting arms 25 are respectively situated over the four corners situated at the upper part of a frame which forms with the arms 25 the load-engaging means of the invention, this means being connected to the vehicle by a connecting means which includes the joints 28*b*. The arms 25 are pivotally connected at their lower ends by pivots 28*a* to the upper four corners of the frame of the load-engaging means. These pivots 28*a* and 28*b* are, for example, in the form of ball joints, as indicated in FIG. 7, so that the arms 25** are freely turnable in all directions with respect to the vehicle as well as with respect to the frame of the load-carrier means.

This frame of the load-carrier means includes at its lower portion a pair of substantially L-shaped members which are situated substantially in a common horizontal plane. FIG. 4 illustrates the pair of lower L-shaped members 21 of this frame, the L-shaped member 21 respectively having one pair of relatively short legs, situated at the right in FIG. 4, pivotally connected to each other at their adjoining free ends by way of a hinge 29 which interconnects the L-shaped members 21 to each other for turning movement with respect to each other about a substantially upright axis. Thus by reason of this connection 29 it is possible for the L-shaped members 21 to turn with respect to each other in a horizontal plane.

At the regions of their outer left ends, as viewed in FIGS. 3 and 4, the longer legs of the L-shaped members 21 are fixed to a pair of upright members 23 which thus extend upwardly from the members 21, and a pair of additional members 23 are fixed to the longer legs of the L-shaped members at the region of the ends thereof which are connected to the outer ends of the shorter legs. Thus, the upper ends of the upright arms 23 of the frame form the four corners thereof to which the lower ends of the arms 25 are pivotally connected by way of the ball joints **28*a*. The shorter legs of the L-shaped members 21 fixedly carry, respectively, a pair of load-engaging elements 32 in the form of suitable pins, while the longer legs of the L-shaped members fixedly carry at the region of their outer ends a pair of additional engaging elements 33 in the form of suitable pins. Outwardly of these side pins 33 the longer legs of the L-shaped members 21 carry a pair of guide means 34 in the form of suitable curved elements having outer convex surfaces capable of engaging the load 20 for guiding the load-engaging means with respect thereto. Thus, the load 20 may be in the form of a suitable container having any desired material therein and resting on a surface such as the surface S indicated in FIGS. 1–3, this surface S being the same surface as that on which the vehicle 10 travels. The outer free ends of the longer legs of the L-shaped members 21 define between themselves an entrance space through which it is possible for the load 20 to be received in the space defined by the L-shaped members 21, this space being clearly apparent from FIG. 4. Thus when a load 20 is to be engaged and transported, the vehicle 10 will travel toward the left, as shown by the arrows F in FIGS. 3 and 4, so that the longer legs of the L-shaped members 21 will become situated along and outside of the opposed longer sides of the illustrated load 20, while the shorter legs of the L-shaped members 21 approach the relatively narrow end 20*a*** of the load.

The load is provided at the corners thereof, namely at the corners of the outer container, with corner elements 40 which are hollow and which have openings through which the pins 32 and 33 can enter into the corner elements 40, these corner elements of course being fixed to the outer container of the load 20.

A spring means 31, in the form of a suitable coil spring, is connected at its opposed ends to a pair of lugs which are fixed to and project from the shorter legs of the L-shaped members 21, so that when a load is not engaged by the load-carrier means the L-shaped members 21 will be in the position indicated in FIG. 4 where the longer legs of the L-shaped members 21 diverge from each other in a direction extending away from the shorter legs thereof. In this way it is possible for the load to be conveniently received within the space defined by the L-shaped members 21 while the load-carrier means is transported together with the vehicle 10 in the direction of the arrow F with respect to the load which initially simply rests on the surface S.

Figure 5:
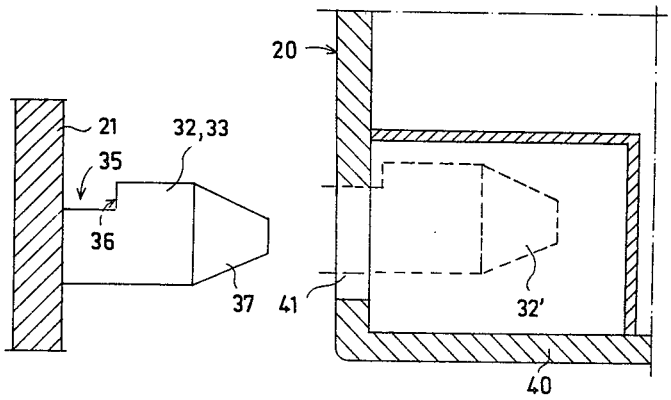
FIG. 5 is a schematic sectional illustration of the manner in which an engaging element for engaging the load is in the process of entering a lower corner piece of the load.

FIG. 5 illustrates in greater detail the construction of the engaging elements 32, 33 and the corner elements 40 which are fixed to the load 20. Thus, these engaging elements 32, 33 are in the form of substantially cylindrical pins fixed to and extending from the L-shaped members 21 and terminating in outer substantially frustoconical tapered ends 37 capable of conveniently entering through the openings 41 into the hollow interior of the corner elements 40 so as to guide the pins 32, 33 into these corner elements. Behind their tapered free ends 37 the pins 32, 33 are provided with upper recesses 35 terminating in shoulders 36. Thus, after the pins 32, 33 reach the position 32' shown in dotted lines in FIG. 5, the upper edge regions of elements 40 which define the openings 41 are capable of being received in the recesses 35 so as to cooperate with the shoulders 36 to provide a secure connection between the load-carrier means and the load.

Figure 6:
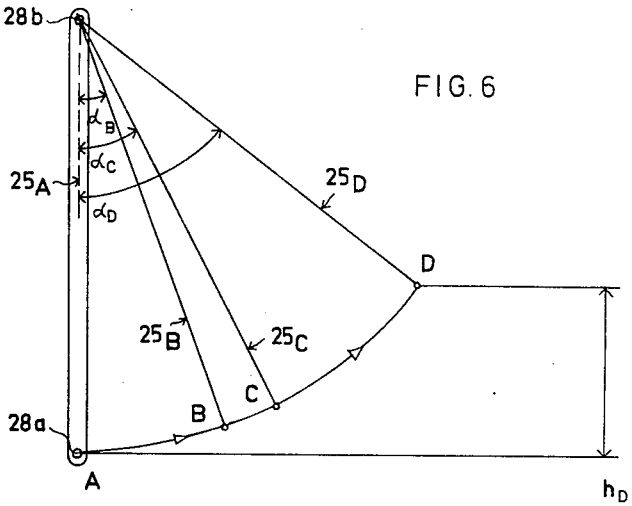
FIG. 6 is a schematic illustration of various steps in the method of the invention.

The method of the present invention which is carried out by the above-described structure of the invention is illustrated schematically at its various stages in FIG. 6. When it is desired by way of the straddle truck 10 to raise the load 20 in order to transport the same, the truck is driven with the load-carrier means in the condition shown in FIG. 4 so that the load 20 will be received in the space defined by the L-shaped members 21. Thus these members 21 extend around the opposed longer sides and right end 20*a* of the load, while the opposed end thereof remains free. At this time, which is to say when the load-carrier means is displaced with respect to the load to assume a position as shown in FIG. 4, the vehicle is driven at a relatively low speed of, for example, 3 to 4 km/h. While thus moving approximately at this relatively low speed, the hinged connection 29 between the shorter legs of the members 21 will strike against the end 20*a* of the load. While the truck 10 continues to move in the direction of the arrow F shown in FIGS. 3 and 4, the longer legs will swing inwardly toward each other, stretching the spring 31 while the hinged connection 29 remains in engagement with the end 20*a* of the load, and thus the pins 32 and 33 will be received in the corner elements 40 in the manner described above.

The above step of engaging the load with the load-carrier means is illustrated in FIG. 6 at the point A where the lifting arms 25 still hang vertically from their upper connections 28*b* and thus have the position 25*a* indicated in FIG. 6.

After the load has been thus engaged by the load-carrier means, the load 20 continues to rest directly on the surface S while the truck 10 continues to travel in the direction of the arrows F, as a result of the kinetic energy of the vehicle 10. Of course, since the load 20 remains stationary on the surface S, the load-carrier means which engages the load also remains stationary therewith during this continued travel of the vehicle, so that as a result the arms 25 turn with respect to the vehicle to the position 25*b*, the arms 25 thus turning with respect to the vehicle about the pivots 28*b* through the angle $\alpha_B$. It will be noted that due to the swinging movement at the pivots 28*b* the lower ends of the arms 25 move upwardly while swinging in the manner indicated in FIG. 6, thus tending to raise the L-shaped members 21, achieving in this way a secure connection of the elements 40 in the recesses 35. However, the engagement of the elements 32, 33 with the corner elements 40 to assume with respect thereto the position 32' shown in dotted lines in FIG. 5 requires only a relatively small upward movement which is less than the elevation through the pivots 28 move upwardly to reach the point B indicated in FIG. 6. As a result, during this initial stage the load-carrier means acts through the weight of the load on the vehicle itself to tend to pull the latter downwardly more forcefully against the surface S on which the vehicle travels, so that the tires of the wheels 13 as well as the spring suspension of the vehicle become compressed by the time the point B is reached.

The vehicle 10 continues to travel, and during this continued travel of the vehicle the arms 25 turn beyond the location 25B shown in FIG. 6 to reach the position 25C. During this turning of the arms from the point B of FIG. 6 to the point C, the load 20 slides with respect to the surface S and this sliding or frictional engagement continues only through a relatively small distance until the arms 25 reach the position 25C, having turned through the angle $\alpha_c$, with the result that the load 20 starts to rise upwardly away from the surface S, and after this turning of the arms 25 continues up to the position 25D, the arms now having turned through the angle $\alpha_D$, the point D shown in FIG. 6 is reached, and during this time from the point C to the point D the springs of the vehicle suspension and the tires of the wheels have expanded at least partly back toward their initial condition to assume the condition which results from the weight of the straddle truck plus the load and the load-carrier means.

In this way the load 20 is completely elevated upwardly away from the surface S through the distance $h_D$ indicated in FIG. 6.

Thus, by way of the above method and apparatus of the invention it is possible to utilize the kinetic energy of the travelling vehicle as well as the friction between the load and the surface on which it initially rests and/or the inertia of the load to bring about elevation of the load above the surface S into a horizontal position suitable for transporting to a desired location. It is to be noted that the arms 25 form a parallelogram linkage which will maintain the load in its horizontal attitude as it is elevated.

In order to maintain the load 20 in its elevated position for horizontal transport, in connection with at least one of the arms 25 a releasable lock means is provided. Thus, FIG. 3 shows at the left arm 25 illustrated therein a lock plate 26 having ratchet teeth situated along a circle whose center is in the axis of the left pivot 28*b* of FIG. 3, this ratchet 26 cooperating with a pawl 27 carried by the frame of the vehicle so that when this left arm 25 of FIG. 3 turns to the position 25D shown in FIG. 6, the releasable lock means 26, 27 will prevent return of the arm 25 back to its vertical position, so that the load will be maintained in its elevated condition. When the destination of the load is reached and it is desired to return the load back to the surface S, the releasable lock means is released simply by pulling upwardly on the pawl 27 by way of a suitable release means 30 which is schematically illustrated in FIG. 3.

Thus, with the above method and apparatus of the invention, the engagement of the load 20 and the elevation thereof into the horizontal transport position has been carried out "on the run" without requiring any particular power means for elevating the load 20.

Many different variations are possible both with respect to the method and with respect to the apparatus of the invention. For example, the method of the invention may also be carried out in such a way that the load-carrier means is placed in engagement with the load at a very low speed of the vehicle 10, or the engagement of the load by the load-carrier means may even be carried out while the vehicle 10 is stationary. Thus, once the L-shaped members 21 have been moved slightly beyond the position shown in FIG. 4 in the direction of the arrow F, the vehicle can be stopped, and the L-shaped members 21 can be turned manually in the direction indicated by the arrows G so as to provide for engagement of the load with the load-carrier means of the invention. In this case, after the load is thus engaged by the load-carrier means, the movement of the vehicle is again started with the vehicle being driven forwardly with a fairly high acceleration, so as to carry out again the steps illustrated in FIG. 6 and described above. In this way, at the beginning while the container or load 20 is stationary on the surface S, the velocity of the truck 10 is accelerating, and the load 20 remains stationary up to the point B shown in FIG. 6 while the arms 25 turn to the position 25B, whereupon the container or load 20 begins, as a result of its inertia forces and as a result of the acceleration forces of the truck 10, to rise up into the air at the step consistent with the point C in FIG. 6, and thereafter the succeeding steps of the method are repeated as described above.

It is also possible to operate the load-carrier means in such a way that it engages the load in a manner different from that described above and shown in the drawings. For example the dimensions of the members 21 may be changed so that the load is initially engaged at a longer side thereof with the arms of members 21 which initially diverge from each other closing in upon the narrower ends of the load.

Moreover, it is not essential to use a pawl and ratchet as a releasable lock means. For example as shown at the upper right portion of FIG. 3 it is possible to connect to one of the arms 25 a fluid-pressure means 42 which may be hydraulic or pneumatic, this means 42 including a piston pivotally connected at the outer end of its piston rod to the arm 25 and a cylinder pivotally connected to the frame of the vehicle. Such a fluid-pressure means will include a one-way valve permitting the right arm 25 of FIG. 3 to turn in a counterclockwise direction as viewed in FIG. 3, while preventing the reverse turning until the one-way valve is opened in a known way so as to release the load for return to the surface S. Thus it is also possible to utilize a fluid-pressure means as the releasable lock means for maintaining the load in its elevated condition. Of course, if desired a means such as the means 42 may also be utilized to assist in elevating the load, although it is not at all necessary for this purpose, as is apparent from the above description.

What is claimed is:

1. In a method for transporting a load which initially rests on a given surface, the steps of engaging the load with a load-carrier means which after engaging the load is capable of elevating the load above said given surface when said load carrier means is elevated with respect to said given surface, said load-carrier means being attached to a transporting vehicle for movement with respect thereto in a direction which elevates said load-carrier means with respect to said given surface when the vehicle travels with respect to the load while the load-carrier means engages the load to resist movement of the load-carrier means with the travelling vehicle, and propelling the vehicle while the load-carrier means remains in engagement with the load, the load-carrier means being attached to the vehicle for swinging movement with respect thereto about at least one axis which extends transversely with respect to the direction in which the vehicle is propelled and which is situated at an upper part of the load-carrier means, to utilize the force of friction of the load with respect to said given surface and the inertia of the load as well as the kinetic energy of the travelling vehicle to initially tend to cause the connection between the vehicle and the load through the load-carrier means attached to the vehicle to cause the vehicle to press more forcefully against the surface on which the vehicle travels while the continued propelling of the vehicle which is resisted by the load connected to the vehicle through the load-carrier means causes the load-carrier means to swing with respect to the vehicle about said axis to elevate the load with respect to said given surface.

2. In a method as recited in claim 1 and wherein the surface on which the vehicle travels is said given surface.

3. In a method as recited in claim 1 wherein the step of engaging the load with the load-carrier means is accomplished while the vehicle moves with respect to the load and wherein the step of propelling the vehicle whereupon the load-carrier means and the load therewith are elevated with respect to said given surface is accomplished without interrupting the movement of the vehicle.

4. In a method as recited in claim 1 and wherein the step of engaging the load with the load-carrier means is accomplished while the vehicle is stationary, and wherein the propelling step comprises accelerating the vehicle to bring about raising of the load upwardly away from said given surface.

5. In a method for transporting a load which initially rests on a given surface, the steps of engaging the load with a load-carrier means which is attached to a transporting vehicle, the engagement being accomplished while the vehicle moves with respect to the load, the load carrying means being capable of elevating the load above said given surface when said load carrier means is elevated with respect to said given surface, said load-carrier means being adapted for movement with respect to the vehicle in a direction which elevates said load-carrier means with respect to said given surface when the vehicle travels with respect to the load while the load-carrier means engages the load to resist movement of the load-carrier means with the travelling vehicle, and propelling the vehicle without interrupting the movement of the vehicle while the load-carrier means remains in engagement with the load so that the load initially slides with respect to said given surface to utilize the force of friction of the load with respect to said given surface and the inertia of the load as well as the kinetic energy of the travelling vehicle to initially tend to cause the connection between the vehicle and the load through the load-carrier means attached to the vehicle to cause the vehicle to press more forcefully against the surface on which the vehicle travels while the continued propelling of the vehicle causes the load to rise away from the given surface to reach a stage where the load travels with the vehicle at the same speed as the vehicle while being elevated from said given surface with the load-carrier means assuming with respect to the vehicle a position different from the initial position of the load-carrier means with respect to the vehicle and locking the load-carrier means with respect to the vehicle when said stage is reached where the load is elevated from said given surface and travels with the vehicle at the same speed as the vehicle.

6. In a method as recited in claim 5 and wherein said load-carrier means initially has an open position defining a space for receiving the load, and initially directing the travelling vehicle along a path which will situate the load in said space to be engaged by the load-carrier means, and engaging the load with the load-carrier means in response to movement of the load-carrier means with respect to the load when the load is received in said space.

7. In a method as recited in claim 6 and including the step of providing for the load-carrier means an operation according to which during the engaging step the load-carrier means automatically closes in upon and engages the load as the vehicle moves the load-carrier means with respect to the load.

8. In a method as recited in claim 7 and wherein the load has a narrow end and a pair of elongated sides, and including the steps of initially engaging the load at said narrow end thereof with the load-engaging means and then causing the load-carrier means to close inwardly toward the elongated sides of the load in response to movement of the load-carrier means with respect to the load during travel of the vehicle.

9. In a method for transporting a load which initially rests on a given surface, the steps of engaging the load with a load-carrier means which after engaging the load is capable of elevating the latter above said given surface when said load carrier means is elevated with respect to said given surface, said load-carrier means being attached to a transporting vehicle for movement with respect thereto in a direction which elevates said load-carrier means with respect to said given surface when the vehicle travels with respect to the load while the load-carrier means engages the load to resist movement of the load-carrier means with the travelling vehicle, and propelling the vehicle while the load-carrier means remains in engagement with the load to compress a spring-suspension and/or wheel tires of the vehicle while the load remains in engagement with said given surface to utilize the force of friction of the load with respect to said given surface and the inertia of the load which resist travel of the vehicle as well as the kinetic energy of the travelling vehicle to initially tend to cause the connection between the vehicle and the load through the load-carrier means attached to the vehicle to cause the vehicle to press more forcefully against the surface on which the vehicle travels while the continued propelling of the vehicle causes the load to be elevated with respect to said given surface with the load-carrier means assuming with respect to the vehicle a position different from the initial position of the load-carrier means with respect to the vehicle utilizing subsequent expansion of said spring suspension and/or wheel tires to contribute to raising of the load from said given surface.

10. In a method as recited in claim 9 and including the step of locking the load-carrier means in the condition where the load is raised from said given surface.

* * * * *